US005699086A

United States Patent [19]

Shimizu

[11] Patent Number: 5,699,086

[45] Date of Patent: Dec. 16, 1997

[54] METHOD AND APPARATUS FOR CONTROLLING IMAGE DISPLAY

[75] Inventor: Hirotoshi Shimizu, Kawasaki, Japan

[73] Assignee: Fujitsu, Limited, Kanagawa, Japan

[21] Appl. No.: 577,117

[22] Filed: Dec. 22, 1995

[30] Foreign Application Priority Data

Mar. 17, 1995 [JP] Japan ..... 7-059417

[51] Int. Cl.[6] ..... G09G 5/00

[52] U.S. Cl. ..... 345/185; 395/511

[58] Field of Search ..... 345/185, 186, 345/201, 203; 395/507, 511

[56] References Cited

U.S. PATENT DOCUMENTS 5,530,458 6/1996 Wakasu ..... 345/185

*Primary Examiner*—Mark R. Powell
*Assistant Examiner*—Matthew Luu
*Attorney, Agent, or Firm*—Helfgott & Karas, P.C.

[57] ABSTRACT

A system for controlling an image display which enables the efficiency of transfer of image data to be greatly improved when a control processor and display control unit access an image memory at alternate timings, the control processor updates the image data, and the display control unit displays the image data on a display, wherein the control processor is first made to wait so that the relative deviation in phase between the operational cycle (T1 to T4) of the control processor and the alternate access cycle of the control processor and display control unit specified by the display control unit is initially set to a certain relative relationship so that the two accesses do not conflict, then the image data is transferred without waiting.

10 Claims, 9 Drawing Sheets

Fig. 2A 1) CPU PHASE (ALE)

Fig. 2B 2) CPU ADDRESS

Fig. 2C 3) DISPLAY ADDRESS

Fig. 2D 4) ACCESS SIGNAL

Fig. 2E 5) IMAGE MEMORY ADDRESS

Fig. 2F 6) RD/WR SIGNAL

Fig. 2G 7) WAIT SIGNAL

Fig. 2H 8) RD/WR' SIGNAL

Fig. 2I 9) CPU OPERATION

Fig.4A 1) CPU PHASE (ALE)

Fig.4B 2) CPU ADDRESS

Fig.4C 3) DISPLAY ADDRESS

Fig.4D 4) ACCESS SIGNAL

Fig.4E 5) IMAGE MEMORY ADDRESS

Fig.4F 6) RD/WR SIGNAL

Fig.4G 7) WAIT SIGNAL

Fig.4H 8) RD/WR' SIGNAL

Fig.4I 9) CPU OPERATION

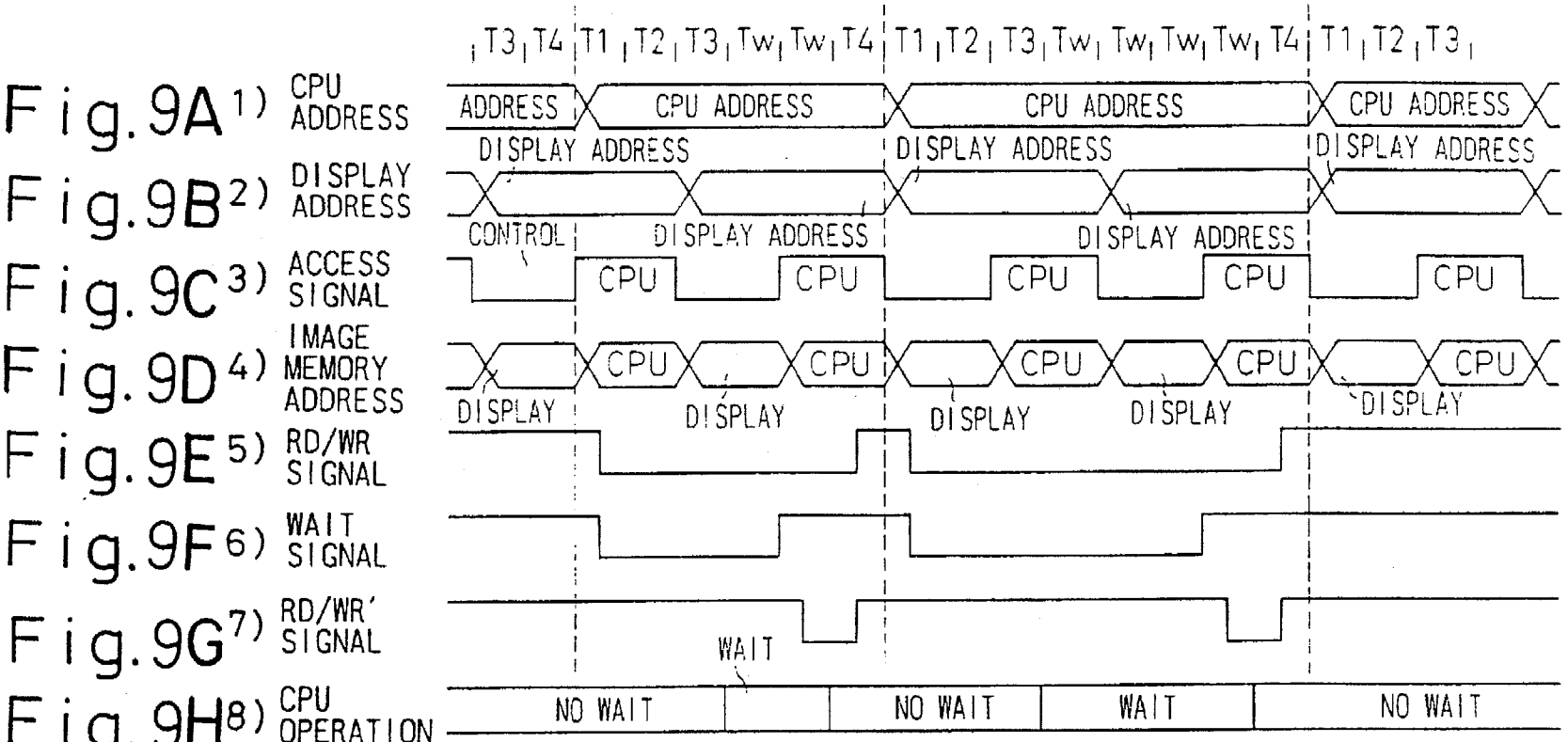
Fig. 9A 1) CPU ADDRESS
Fig. 9B 2) DISPLAY ADDRESS
Fig. 9C 3) ACCESS SIGNAL
Fig. 9D 4) IMAGE MEMORY ADDRESS
Fig. 9E 5) RD/WR SIGNAL
Fig. 9F 6) WAIT SIGNAL
Fig. 9G 7) RD/WR' SIGNAL
Fig. 9H 8) CPU OPERATION

METHOD AND APPARATUS FOR CONTROLLING IMAGE DISPLAY

BACKGROUND OF THE INVENTION

1. Field of the Invention

The present invention relates to a method and apparatus for controlling an image display, more particularly to a technique for the control of the display of an image at a terminal provided with an image display apparatus (display screen).

In general, image display systems include an image memory for storing the image data to be displayed, a control processor (CPU) for accessing the image memory and rewriting the image data to update it, and a display control unit for accessing the image memory periodically at access cycles alternating with the CPU to read out the image data and transfer it to the image display apparatus (display screen). Of course, this configuration is applied to inexpensive terminals using an SRAM or DRAM having only a single port as the image memory and is not applied to expensive terminals (high performance PCs etc.) incorporating dual port SRAMs.

However, looking at the market, there is extremely vigorous demand for such inexpensive terminals. For example, these include electronic notebooks, notebook PCs, telephone sets with simple displays, etc. The present invention relates to the image display systems able to be applied to such inexpensive terminals using such single-port image memories. In such an image display system, the CPU and display control unit periodically access the image memory at alternate access timings. Accordingly, in such a system, it is required that the accesses of the image memory by the CPU and the display control unit absolutely do not conflict with each other. If such a conflict were to occur, then that conflict would appear as noise on the image display apparatus (display screen) and result in so-called flickering and thereby cause the quality of the displayed image to deteriorate.

Usually, when such a conflict occurs, the above system is designed to give priority in access to the display control unit over the CPU. This is to enable swift provision of the displayed image on the display screen.

2. Description of the Related Art

As will be explained in detail later with reference to the drawings, the conventional image display system is provided with a control processor (CPU), image memory, display control unit, image display apparatus (display screen), address selector, display clock generating circuit, local bus, etc.

In a general inexpensive terminal, use is often made of inexpensive CPUs of about capacities, such as 8-bit capacities. Accordingly, high speed access of the image memory is not possible. Therefore, when the image memory is accessed by the CPU, an asynchronous wait is inserted at the CPU (a wait signal is sent), the CPU enters a wait cycle, the display of the image data at the image display apparatus by the display control unit is completed immediately thereafter, then the waiting state is released and the access to the image memory by the CPU which had been kept waiting is started. That is, the CPU enters a wait cycle each time access by the CPU occurs. When an access by the CPU to the image memory occurs, the display control unit generates a wait signal. That wait signal is released when the access by the display control unit to the image memory has been completed.

In short, the system operates with priority given in display by the display control unit, so the CPU ends up having to be kept waiting.

Thus, in the conventional image display system, when the CPU accesses the image memory, noise is prevented from appearing on the display screen by having the CPU always made to wait and having priority given to the display control unit.

Due to the use of this asynchronous wait, when for example a large amount of data is to be transferred continuously in the system by the CPU, there was the problem that the average speed of data transfer became remarkably lower.

SUMMARY OF THE INVENTION

The present invention was made in consideration of the above problems and has as its object to shorten the waiting time of the CPU caused by the occurrence of the asynchronous wait as much as possible and to increase the average speed of data transfer in the system.

To attain the above object, the present invention is configured as follows:

The control processor is made to wait first so as to initially set the relative phase deviation between the operational cycle (T1 to T4) of the control processor and the alternative access cycle of the control processor and the display control unit, specified by the display control unit to a predetermined relative relationship where there is no conflict between the two, whereby the control processor is then able to transfer image data with no wait. By this, the efficiency of transfer of the image data is remarkably improved when the control processor and the display control unit access the image memory at alternate timings so the control processor can update the image data and the display control unit can display it on the display.

BRIEF DESCRIPTION OF THE DRAWINGS

The above object and features of the present invention will be more apparent from the following description of the preferred embodiments with reference to the accompanying drawings, wherein:

FIG. 9 is a time chart of the operation of the image display system shown in FIG. 8.

DESCRIPTION OF THE PREFERRED EMBODIMENTS

Before describing the embodiments of the present invention, the related art and the disadvantages therein will be described with reference to the related figures.

Figure 8:
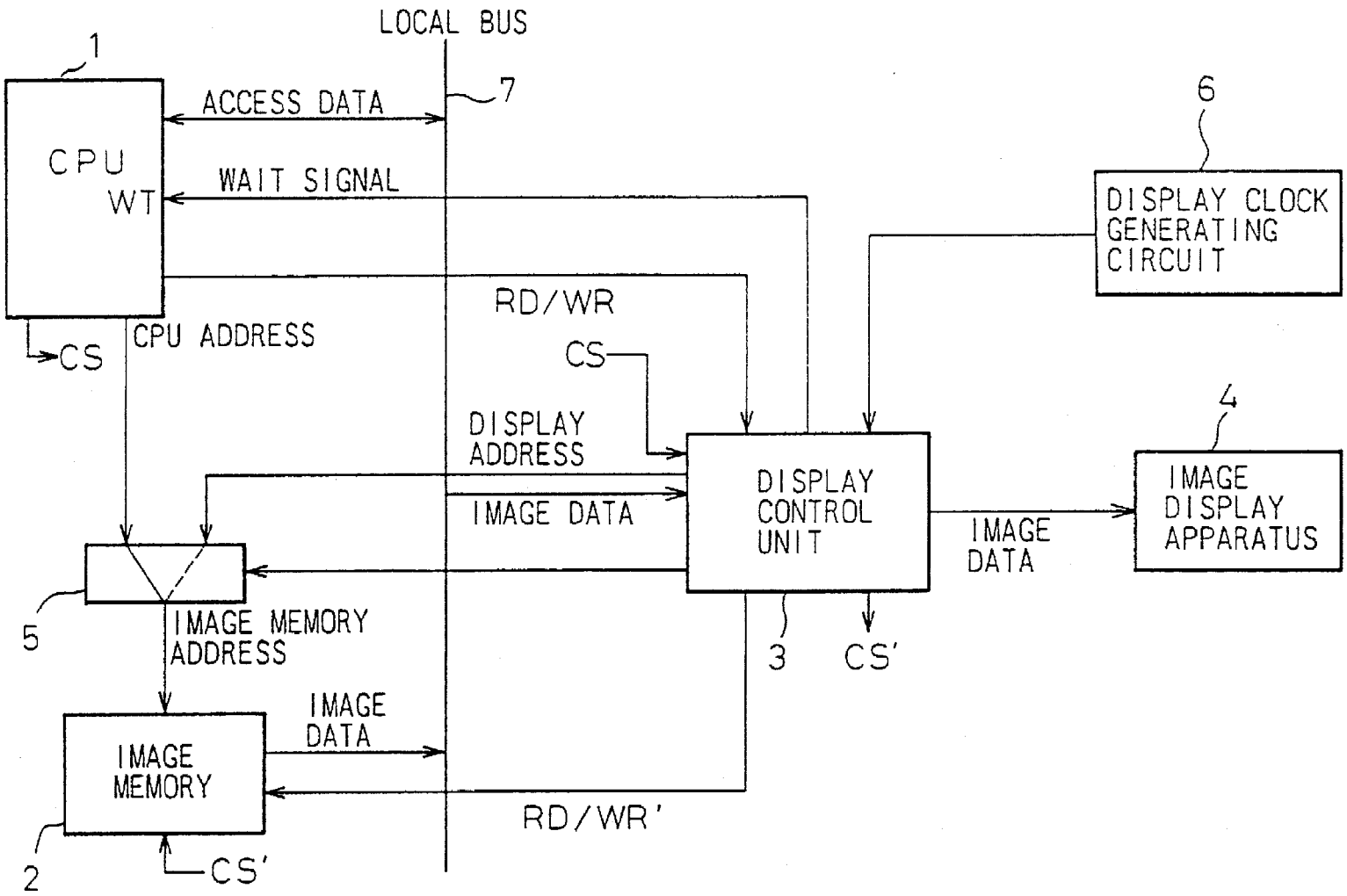
FIG. 8 is a view of the conventional image display system.

FIG. 8 is a view of a conventional image display system. In the figure, reference numeral 1 is a control processor (CPU), 2 is an image memory, 3 is a display control unit, 4 is an image display apparatus (display screen), 5 is an address selector, 6 is a display clock generating circuit, and 7 is a local bus.

The display control unit 3 alternately switches the access to the image memory 2 through the address selector 5 between the CPU 1 side and the display control unit 3 side. When rewriting and updating the content of the image memory 2, the address selector selects the CPU 1 side (solid line side), while when the display control unit 3 is to transfer the content of the image memory 2 to the image display apparatus, the display control unit 3 side is selected.

When the CPU is to rewrite the image data in the image memory 2, the image data is transferred through the local bus 7. When the image data is to be transferred from the image memory 2 to the image display apparatus 4 as well, it is transferred through the local bus 7.

FIG. 9 is a time chart of the operation of the image display system shown in FIG. 8. 1) in this figure shows the timing of appearance of the CPU address produced when the CPU 1 is performing a read/write (RD/WR) operation. Note that this timing is defined by the wait cycle TW as well as the four machine cycles T1, T2, T3, and T4 defining the operational cycle of the CPU 1. Note that the frequency of the machine cycles is exactly the same as the frequency of the display clock from the display clock generating circuit 6, but there is no synchronization at all between them.

2) in the figure shows the timing of occurrence of the display address output from the display control unit 3 for displaying an image on the image display apparatus 4. Note that complete synchronization is maintained between the signal shown in 2) and the signals shown in the later mentioned 3) and 4).

3) in the figure shows an access signal output from the display control unit 3. This alternately selects address from the display control unit 3 ("control") or address from the CPU 1 ("CPU").

4) in the figure shows the image memory address given to the image memory 2. It is switched in accordance with the change of the access signal to the address for image display ("display") or the address for rewriting by the CPU ("CPU").

5) in the figure shows the timing of occurrence of the RD/WR signal output from the CPU 1. However, this RD/WR signal occurs also during access to the main memory, not shown, or the ROM storing the programs in addition to the image memory 2. Whatever the case, it is synchronized with the CPU address of 1).

6) in the figure is a wait signal which occurs from the display control unit 3. When discussing the problems in the related art, this becomes an important signal as it is a factor behind the problems.

7) in the figure is a RD/WR' signal obtained by processing the above RD/WR signal by the display control unit 3. The RD/WR' signal in 7) represent only the timings for accessing the image memory 2 during the above read/write (RD/WR) operations.

8) in the figure shows the status (CPU operation) of the CPU 1 occurring in response to this wait signal. When the wait signal is supplied from the display control unit 3, it shows the wait state starting from the end of the machine cycle T3 (no wait state otherwise). Note that this wait signal is also called an asynchronous ready (ARDY) signal. This wait state ends and the final machine cycle T4 appears when the access signal of 3) of the figure designates the CPU side for the first time after occurrence of the TW.

In the above inexpensive terminal, use is often made of inexpensive CPUs of about capacities, such as 8-bit capacities. Accordingly, high speed access of the image memory 2 is not possible. Therefore, when the image memory 2 is accessed by the CPU 1, an asynchronous wait is inserted at the CPU 1 (a wait signal is sent), the CPU 1 enters a wait cycle, the display of the image data at the image display apparatus 4 by the display control unit 3 is completed immediately thereafter, then the wait state is released and the access to the image memory 2 by the CPU 1 which had been kept waiting is started. That is, the CPU 1 enters a wait cycle each time access by the CPU 1 occurs. This has already been mentioned with reference to FIG. 9 and when an access by the CPU 1 to the image memory 2 occurs, the display control unit 3 generates a wait signal. That wait signal is released when the access by the display control unit 3 to the image memory 2 has been completed.

In short, the system operates with priority given in display by the display control unit 3, so the CPU 1 ends up having to be kept waiting.

Thus, in the conventional image display system, when the CPU 1 accesses the image memory 2, noise is prevented from appearing on the display screen by having the CPU 1 always made to wait and having priority given to the display control unit 3.

Due to the use of this asynchronous wait, when for example a large amount of data is to be transferred continuously in the system by the CPU 1, there was the problem that the average speed of data transfer became remarkably lower.

The present invention shortens the waiting time of the CPU caused by the occurrence of the asynchronous wait as much as possible and increases the average speed of data transfer in the system.

The present invention shortens the waiting time of the CPU caused by occurrence of an asynchronous wait by preadjusting the relative deviation between the operational cycle of the CPU 1 and the access cycle defined by the display control unit 3 and presetting a certain phase relationship between the CPU 1 and the display control unit 3 so that the access cycle of the CPU 1 and the access cycle of the display control unit 3 do not conflict with each other and, as a result, enables continuous operation of the CPU 1 without waiting.

In a first embodiment, the method comprised of the following steps is provided:

First Step

When the control processor (CPU) 1 requests rewriting of the image data in the image memory 2, the relative deviation between the operational cycle of the CPU 1 and the access cycle specified by the display control unit 3 is detected.

Second Step

A wait signal of a length proportional to the size of the relative deviation which has been detected is input to the CPU 1.

Third Step

The CPU 1 accesses the image memory 2 using consecutively the access cycle assigned to the CPU 1 without input of any wait signal after the input of the first wait signal.

That is, the relative deviation between the operational cycle of the CPU 1 and the access cycle specified by the display control unit 3 (due to the access signal) is initially set to a relative relationship so that no conflict occurs between the access of the CPU 1 and the access of the display control unit 3. Accordingly, after this, there is no longer a need for keeping the CPU 1 waiting and the speed of data transfer in the system can be made much faster compared with the case in the related art where the CPU 1 is made to wait once with each access by the CPU 1.

When the operational cycle of the CPU 1 is defined by a repetition of the series of machine cycles T1, T2, T3, and T4, the correspondence between the size of the relative deviation and the length of the wait signal at the second step is set so that the access cycle allocated to the CPU 1 at the third step is made to match with the machine cycles T2 and T3.

That is, adjustment is performed so that the access cycle of the CPU 1 occurs at the timing of the machine cycles T2 and T3 positioned at the center of the operational cycle of the CPU 1 and so that the access cycle of the display control unit 3 occurs at the timing of the remaining machine cycle T4 and next machine cycle T1 so that there is no conflict between the access by the CPU 1 and the access by the display control unit 3, without making the CPU 1 wait.

The image display apparatus based on the first embodiment has the following configuration in addition to the conventional configuration (FIG. 8), that is, a relative phase detection unit which detects the relative deviation between the operational cycle of the CPU 1 and the access cycle specified by the display control unit 3 and supplies a wait signal of a length proportional to the size of the detected relative deviation to the wait input terminal of the CPU 1.

That is, the relative phase detection unit is introduced to detect the relative deviation between the operational cycle of the CPU 1 and the access cycle specified by the display control unit 3. The pulse width of the wait signal is set in accordance with the relative deviation detected here. The CPU 1 is initially made to wait for exactly that pulse width. Subsequently, the CPU 1 and the display control unit 3 can access the image memory 2 at nonconflicting timings.

The relative phase detection unit uses the timing signal for showing the operational cycle produced conventionally in the CPU 1 as the signal showing the operational cycle of the CPU 1.

That is, the existing timing signal for showing the operational cycle is used as the signal showing the operational cycle. This signal shows at what machine cycle (T1 to T4) the CPU 1 is currently operating at.

The timing signal for showing the operational cycle is made either an address latch enable signal for displaying the timing where the address signal produced in the CPU 1 becomes effective or a status signal for displaying the operational status in the CPU 1.

That is, it is convenient to use an existing address latch enable signal or status signal of a general CPU as the timing signal for display of the operational cycle.

The relative phase detection unit is comprised of a counter unit which is incremented each time one machine cycle of a series of a plurality of machine cycles forming the operational cycle passes and sends out a reset signal each time a machine cycle ends, a first flipflop unit which sends out a set signal with each sampling of a timing signal for display of the operational cycle at the timing of the start of the machine cycle, and a second flipflop unit which is set by that set signal, is reset by that reset signal, and sends out a signal produced during that reset period as the wait signal.

That is, the relative phase detection unit can be realized by a small scale hardware using a counter and flipflops.

In a second embodiment, there is provided a method comprised of the following steps:

First Step

The relative deviation between the operational cycle of the CPU 1 and the access cycle specified by the display control unit 3 is detected.

Second Step

A wait signal of a length proportional to the size of the relative deviation which has been detected is input to the CPU 1, the start of the operational cycle of the CPU 1 is adjusted to match with the start of the access cycle allocated to the CPU 1, and the length of the access cycle allocated to the display control unit 3 is set shorter than the length of the access cycle allocated to the CPU 1.

The display control unit 3 prefetches at least two consecutive addresses' worth of image data from the image memory 2 at each of the shorter set access cycles, then successively transfers them to the image display apparatus 4 before the next access cycle allocated to the display control unit 3.

In this second embodiment, in the same way as the first embodiment, first, the relative deviation is set so that there is no conflict between the access by the CPU 1 and the access by the display control unit 3. The relative relationship is such that the start of the CPU address timing of the CPU 1 and the start of the access timing of the CPU completely match. Further, the access to the image memory 2 is made by at least two consecutive addresses. By using such at least two consecutive addresses worth of image data prefetched, the access cycle able to be given to the CPU 1 is made shorter than the access cycle able to be given to the display control unit 3, so that and the time during which the image memory 2 can be occupied is made much longer for the CPU 1. This enables a substantial elimination of the need for waiting.

The speed of generation of the consecutive addresses can be made to increase just when performing the above prefetch.

That is, the speed of generation of addresses to the image memory 2 is made double or more of the conventional speed so as to enable at least two consecutive addresses worth of image data to be prefetched within each access cycle given to the display control unit 3.

When prefetching two consecutive addresses worth of image data, the logic of the least significant bit of the address given is made to invert at a speed of twice the ordinary speed of accessing the image memory 2.

That is, when prefetching two consecutive addresses worth of image data, the least significant bit of the address can be merely logically inverted.

The image display apparatus based on the second embodiment has the following configuration in addition to the conventional configuration, that is, a relative phase detection unit which detects the relative deviation between the operational cycle of the CPU 1 and the access cycle specified by the display control unit 3 and supplies a wait signal of a length proportional to the size of the detected relative deviation to the wait input terminal of the CPU 1, a register unit for holding the output read out from the image memory 2, and a selector unit for switching and outputting to the display control unit 3 one of the output read out from the image memory 2 and the read out output held at the register unit.

That is, in the image display apparatus of the second embodiment, the register unit and selector unit are provided in addition to the relative phase detection unit. The prefetched image data is stored in the register unit. The selector unit selects the output of the register unit so that the prefetched image data is transferred to the image display apparatus at the following CPU access cycle.

Figure 1:
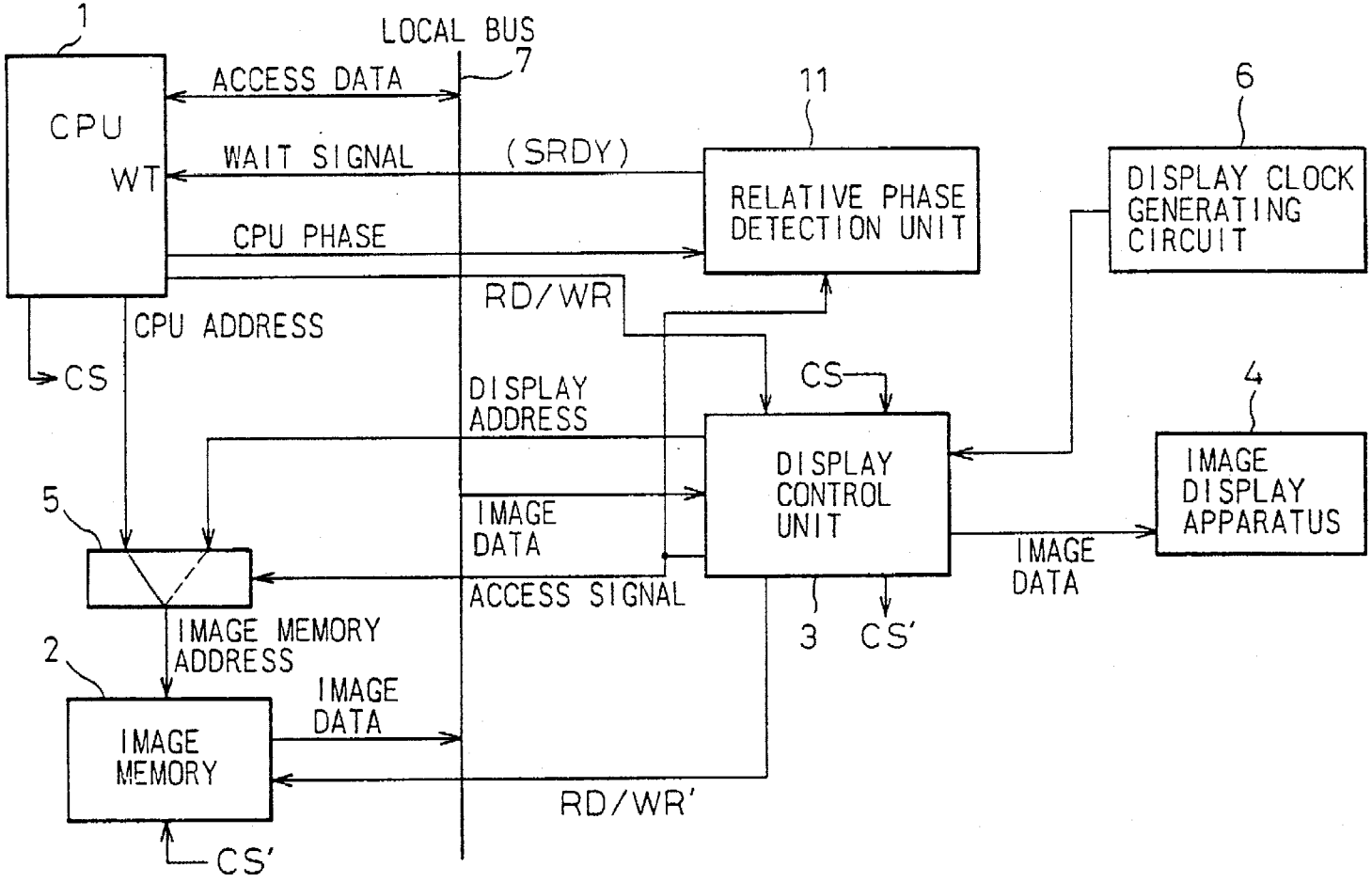
FIG. 1 is a view of a first embodiment according to the present invention.

FIG. 1 is a view of a first embodiment according to the present invention. Note that, components similar to those already explained are shown with the same reference numerals or symbols (same below). Accordingly, the relative phase detection unit given reference numeral 11 is newly introduced. This relative phase detection unit 11 receives as input both the CPU phase signal from the CPU 1, that is, the signal indicating the operational cycle of the CPU 1, and the signal showing the access cycle specified by the display control unit 3, for example, the access signal, and detects the relative deviation between the phases of the two signals.

A wait signal of a length (pulse width) proportional to the size of the relative deviation is supplied to the wait input terminal WT of the CPU 1.

Figure 2:
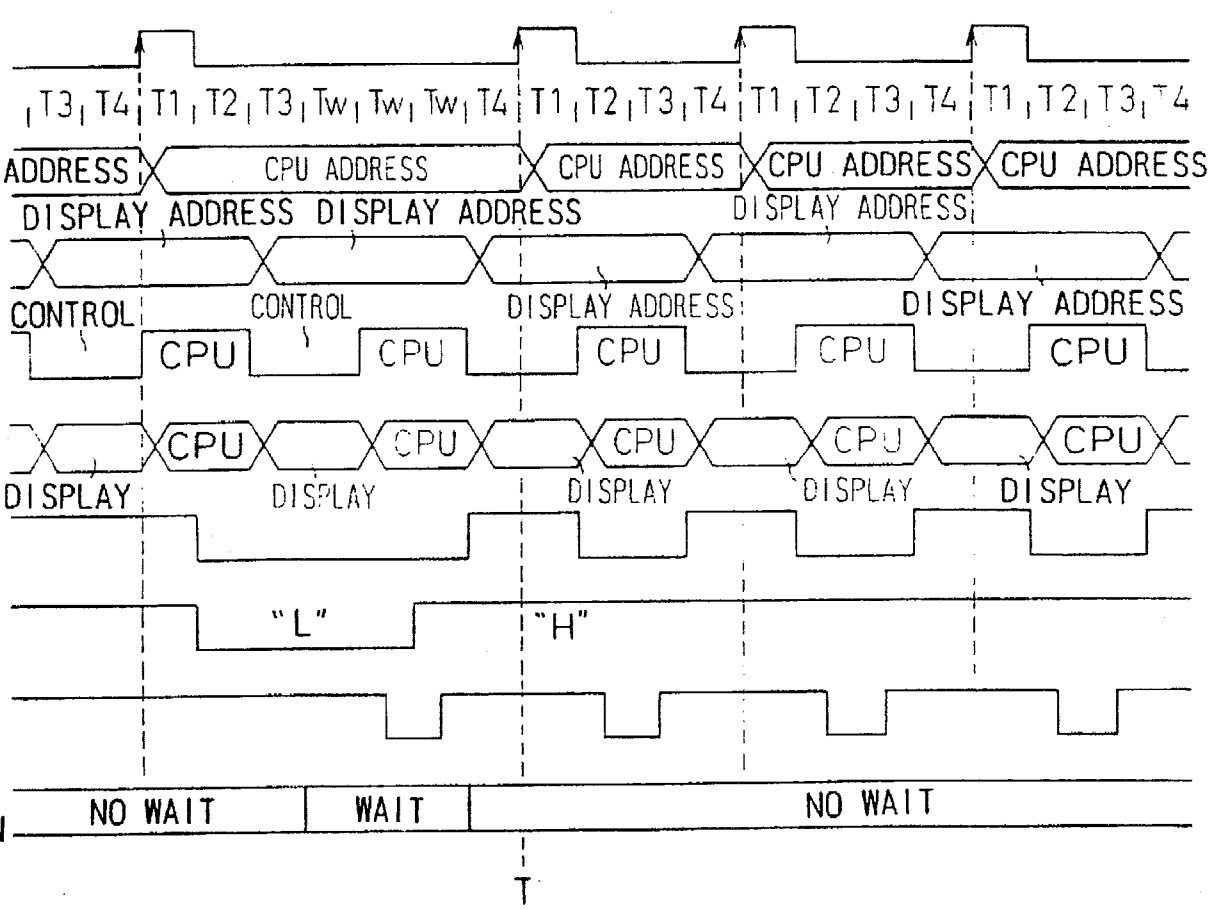
FIG. 2 is a time chart of the operation of the image display apparatus shown in FIG. 1.

FIG. 2 is a time chart of the operation of the image display apparatus shown in FIG. 1. 1) of FIG. 2 shows the signal showing the CPU phase explained above, that is, a timing signal for showing the operational cycle of the CPU 1. This signal for showing the operational cycle may be any signal so long as it enables indication of what machine cycle the CPU 1 is currently operating in. In the example of the figure, the known address latch enable (ALE) signal is shown. This signal ALE is produced in the CPU or is output to the outside each time the machine cycle of the CPU 1 comes to the start of the CPU address shown by 2) in the figure, that is, each time coming to the machine cycle T1. Note that this signal ALE is generally used to show the timing where the address signal produced in the CPU becomes effective.

As the signal for showing the operational cycle, use may be made of a known status signal (normally 3 bits) in addition to the above Signal ALE. This status signal can indicate a maximum of 8 ($2^3$) operational statuses in the CPU.

The relative phase detection unit 11 on one hand receives as input the signal ALE (CPU phase signal) and on the other hand receives as input the known access signal showing the access cycle from the display control unit 3. This access signal has conventionally been used as the signal for switching the address selector 5. This is used for detection of the relative deviation.

According to 4) of FIG. 2, the access cycle alternates between the display control unit 3 side and the CPU 1 side as illustrated due to the access signal. According to the example of FIG. 2, since the relative phase deviation between the CPU phase and the access cycle is zero (rising edge of CPU phase and point of change of access cycle match), a wait signal (see "L" of 7) of FIG. 2) of a length (pulse width) giving a wait cycle TW of 3×TW is produced by the relative phase detection unit 11 and is input to the wait input terminal WT of the CPU 1.

If this is done, then the CPU 1 is made to wait in access during the wait cycle of a length of 3×TW (see 9) of FIG. 2), but then, as shown in 9) of the figure, it is possible to access continuously with no wait. That is, as shown in 2) of FIG. 2, the wait cycle TW does not occur at all after the time T in the figure.

The reason is that due to the insertion of the 3×TW wait cycle, the CPU 1 and the display control unit 3 enter into a certain phase relationship with each other. A fixed phase relationship is maintained so that the machine cycles T2 and T3 are allocated to the CPU 1, while the machine cycles T4 and T1 are allocated to the display control unit 3. So long as this phase relationship is maintained, there can be no conflict in access to the image memory 2 between the two (1, 3). That is, there is no longer a need to keep the CPU 1 waiting.

The example of FIG. 2 shows the mode where the rising edge of the CPU phase (ALE) matches with the point of change of the access cycle, but there are three other modes as well.

<1> In the mode where the rising edge of the ALE signal is at a position of the machine cycle T2 at 2) of FIG. 2, a wait signal of a length (pulse width) giving the above wait cycle TW of 2×TW is applied from the relative phase detection unit 11 to the wait input terminal WT.

<2> In the mode where the rising edge of the ALE signal is at a position of the machine cycle T3 at 2) of FIG. 2, a wait signal of a length (pulse width) giving a wait cycle TW of 1×TW is applied from the relative phase detection unit 11 to the wait input terminal WT.

<3> In the mode where the rising edge of the ALE signal is at a position of the machine cycle T4 (first T4) at 2) of FIG. 2, a wait signal of a length (pulse width) giving a wait cycle TW of zero is applied from the relative phase detection unit 11 to the wait input terminal WT. That is, in this case, there is no need to make the CPU 1 wait.

In FIG. 1, the CS from the CPU 1 is a chip select signal. When accessing various memories, the signal CS is made "L". The chip select signal CS' for accessing the image memory 2 of FIG. 1 (video RAM) among these memories is produced by processing the above signal CS by the display control unit 3.

Figure 3:
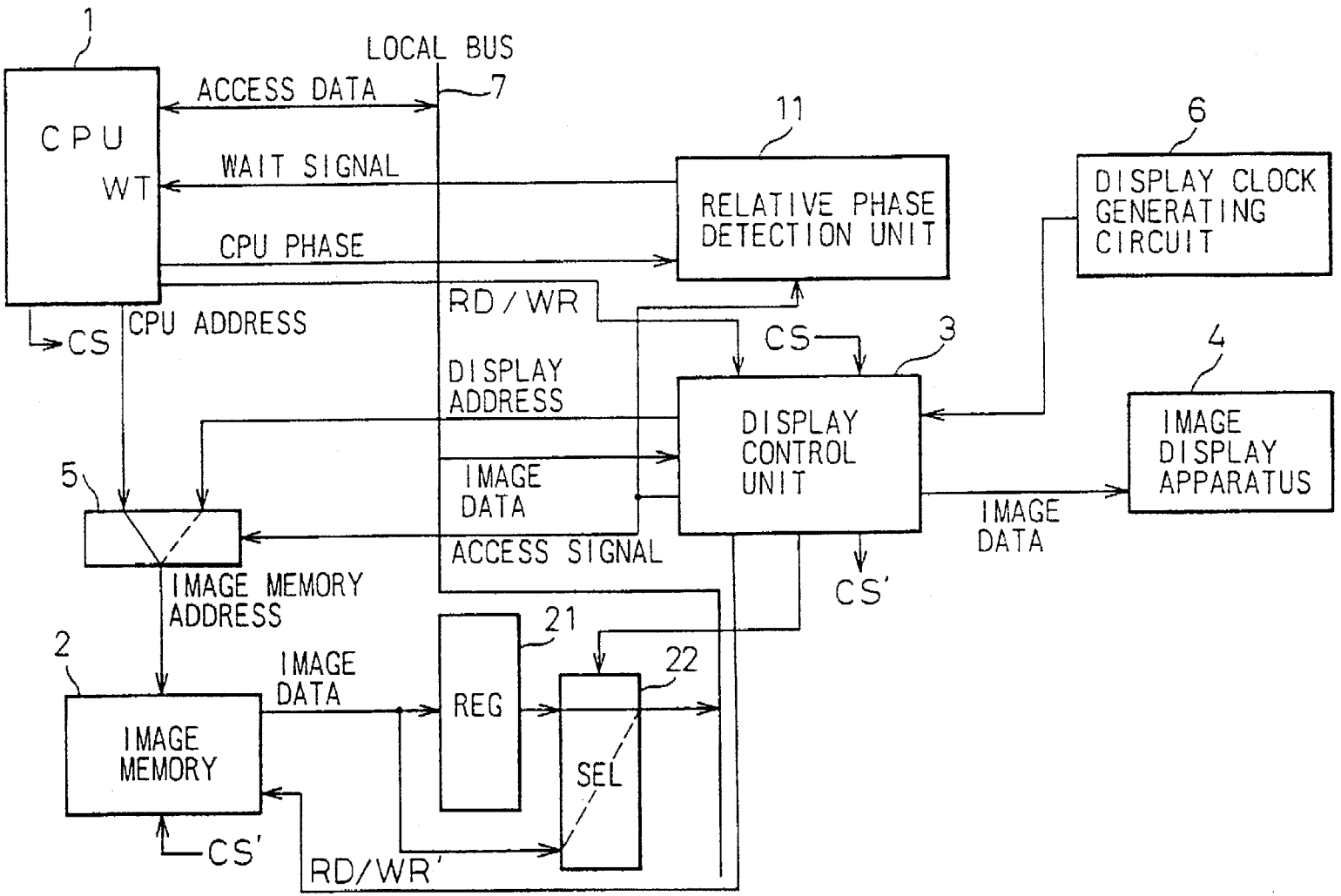
FIG. 3 is a view of a second embodiment according to the present invention.
Figure 4:
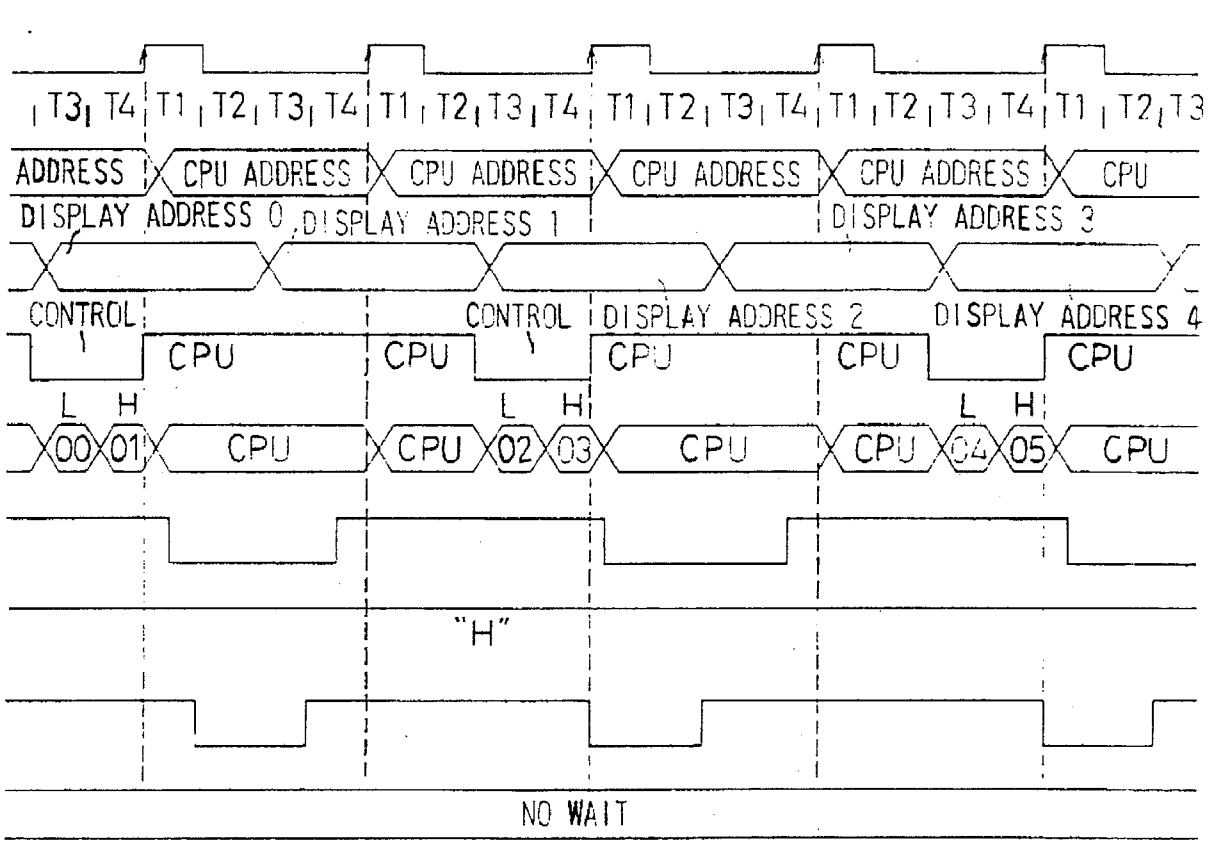
FIG. 4 is a time chart of the operation of the image display apparatus shown in FIG. 2.

FIG. 3 is a view of the second embodiment according to the present invention, while FIG. 4 is a time chart of the operation of the image display apparatus shown in FIG. 3. The principle of the operation of the second embodiment is substantially the same as the principle of operation of the first embodiment. The difference between the case of the second embodiment and the case of the first embodiment is the difference in the fixed phase relationship between the CPU 1 and the display control unit 3 for preventing conflict in access to the image memory 2. That is, the fixed phase relationship in the first embodiment is as shown after the time T in FIG. 2, while the fixed phase relationship in the second embodiment is as shown in FIG. 4. Note that FIG. 4 shows the phase relationship in the steady state after completion of the phase adjustment by the relative phase detection unit 11.

As shown in FIG. 4, in the second embodiment, first, the start of the timing of the CPU address (CPU operational cycle) shown in 2) of the figure is positioned at the point of change of the access cycle allocated to the CPU 1 (see access signal of 4) of the figure). While the CPU 1 is accessing the image memory 2, if there is a change in the address for access, it is not possible to read out the desired image data from the image memory 2 or to write the desired image data in it and, in the end, the data appears as noise on the display screen (4).

Further, in the second embodiment, the length of the access cycle allocated to the display control unit 3 is made shorter than the length of the access cycle allocated to the CPU 1 (see 4) of the figure). As a result, the time during which the image memory 2 is open to the CPU 1 can be made sufficiently longer than even the time the image memory 2 is open to the display control unit 3. Accordingly, there is no longer a need to keep the CPU 1 waiting (see 9) of the figure).

Originally, the reason why the CPU 1 had to be kept waiting was, as mentioned earlier, that the CPU was not high in performance in inexpensive terminals and that therefore the display control unit 3 was made to finish reading out the image data to the image display apparatus 4, then the right of access was handed over to the CPU 1. In the second embodiment, there is no longer a need to insert such a wait since sufficient time for access is secured at the CPU 1.

In this case, conversely, looking at the display control unit 3, the time allowed for accessing the image memory 2 ends up reduced far more than the CPU 1. Therefore, at each of the short access cycles allocated to the display control unit 3, at least two consecutive addresses worth of image data are prefetched from the image memory 2. The example of FIG. 4 shows the case of prefetching two consecutive addresses worth of image data but a look at the image memory addresses of 5) shows that at the address cycles allocated to the display control unit 3, two consecutive addresses such as (00, 01)→(02, 03)→(04, 05)→ . . . are sent from the display control unit 3.

The image data read out from the image memory 2 at the image memory address (00) shown in 5) of FIG. 4 corresponds to the display address 0 shown in 3) of the figure and is transferred to the image display apparatus 4 at the timing of the display address 0. At this time, simultaneously, the image data prefetched at the image memory address (01) is transferred to the image display apparatus 4 after waiting to the timing of the display address 1 shown in 3) of the figure.

Similarly, the image data read out at the image memory address (02) is transferred to the image display apparatus 4 at the timing of the display address 2. The image data prefetched simultaneously at the image memory address (03) is transferred to the image display apparatus 4 after waiting until the timing of the display address 3.

Note that when the image data prefetched at the image memory addresses (01), (03), . . . are transferred to the display control unit 3, the image data are transferred at the timing when the RD/WR signal at 6) in FIG. 4 is switched from "L" to "H" so as not to conflict with the access by the CPU 1 on the local bus 7.

Referring to FIG. 3, the image data read from the image memory 2 at the first half of the two consecutive addresses (00, 02, 04 . . . ) is input to the register unit (REG) 21 and, simultaneously, passes through the selector unit (SEL) 22 (now set to the path of the dotted line in the figure) to reach the display control unit 3.

On the other hand, the image data read from the image memory 2 at the second half of the two consecutive addresses (01, 03, 05 . . . ) overwrites the register unit 21 and is held there. It is transferred to the display control unit when the path in the selector unit 22 is changed to the solid line in the figure.

Figure 5:
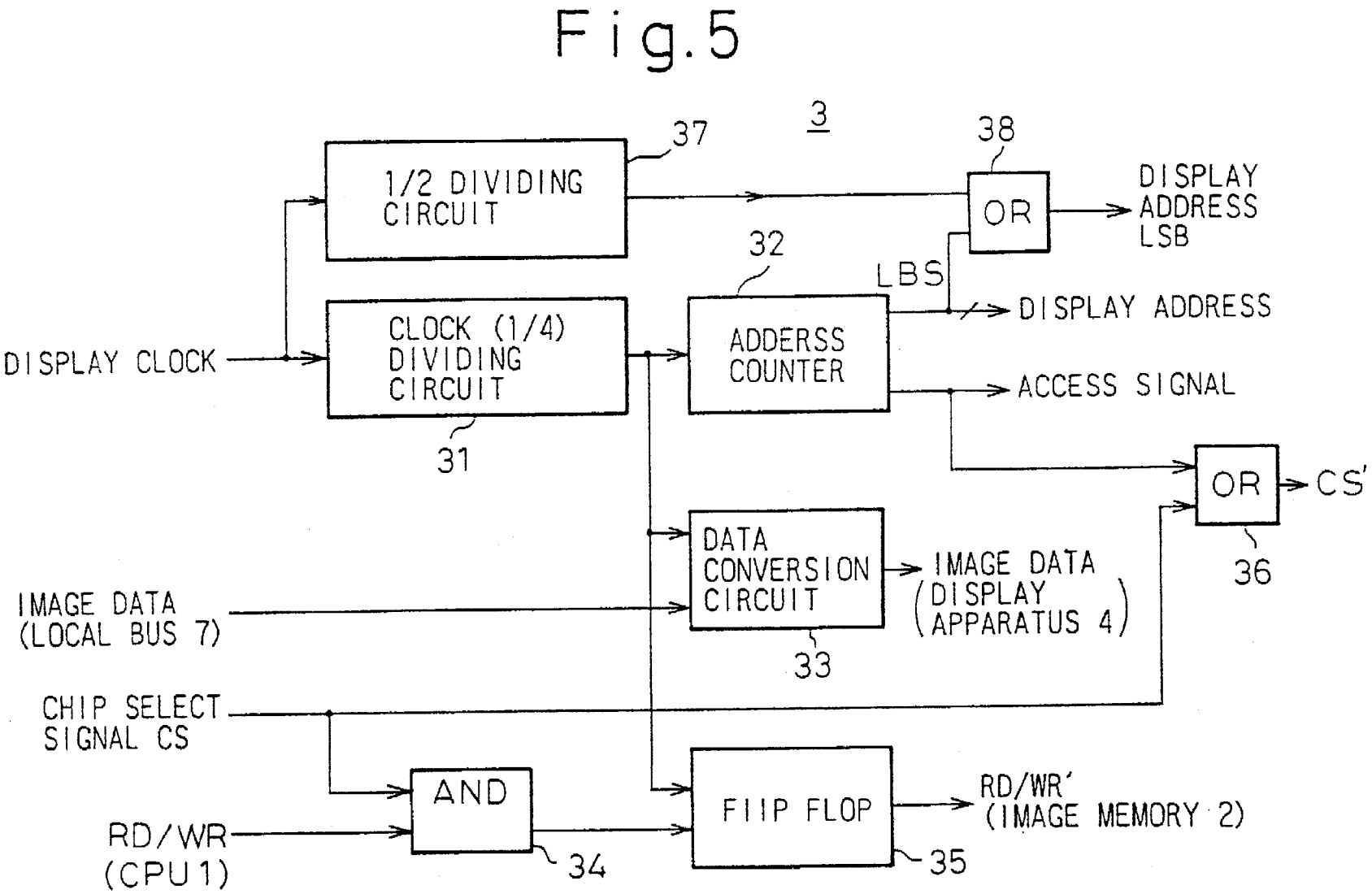
FIG. 5 is a view of a specific example of the display control unit.

FIG. 5 is a view of a specific example of a display control unit. In the figure, the display clock at the top left of the figure is a signal output from the display clock generating circuit 6 (FIG. 1, FIG. 3). As mentioned already, it has the same frequency as the machine cycles T1 to T4. The display clock is matched with the frequency of the operational cycle (T1 to T4) by the clock dividing circuit, for example, the ¼ dividing circuit 31, and applied to the address counter 32. The output of the address counter 32 becomes the incrementally increased display address and is supplied to the image memory 2.

The access signal of the duty ratio 50 percent shown in 4) of FIG. 2 is also output from the address counter 32. However, the address counter 32 housed in the display control unit 3 of FIG. 3, as shown in 4) of FIG. 4, does not have an access signal of a duty ratio of 50 percent, so the address counter 32 has to have added to it a wave conversion circuit, for example, a circuit which obtains the logical OR of the access signal and the signal obtained by dividing the access signal in half and removing the glitch (noise) by a flipflop receiving as input that logical OR output and the output of the circuit 31.

In FIG. 5, the image data on the local bus 7 (FIG. 1, FIG. 3) is supplied through the data conversion circuit 33 to the image display apparatus 4. Note that the data conversion circuit 33 is a circuit provided for converting the parallel data from the image memory 2 to serial data, that is, the general input interface, of the image display apparatus 4 in synchronization with the output of the clock dividing circuit 31.

The chip select signal CS and the read/write (RD/WR) signal from the CPU 1 are supplied to the AND gate 34 and pass through the flipflop 35 to become the read/write (RD/WR') signal to the image memory 2. When the two conditions stand that there is a request for a read/write operation from the CPU 1 and there is a request for a read/write operation to the image memory 2, a read/write (RD/WR') signal to the image memory 2 is produced in synchronization with the output of the clock dividing circuit 31.

Further, when the logic of both the chip select signal CS and the access signal from the address counter 32 (OR conditions under negative) is obtained at the gate 36, the result becomes the chip select signal CS' to the image memory 2.

The ½ dividing circuit 37 and OR gate 38 shown at the top of FIG. 5 are necessary for the display control unit 3 in the case of the second embodiment in particular. The address when reading out the abovementioned prefetched two consecutive addresses worth of image data has to be two times the speed of the display clock from the dividing circuit 31. Therefore, the ½ dividing circuit 37 is provided. The OR logic of the output and the LSB of the display address from the address counter 32 is taken at the OR gate 38 and a display address converting just the LSB from "L" to "H" at a double speed is obtained.

Figure 6:
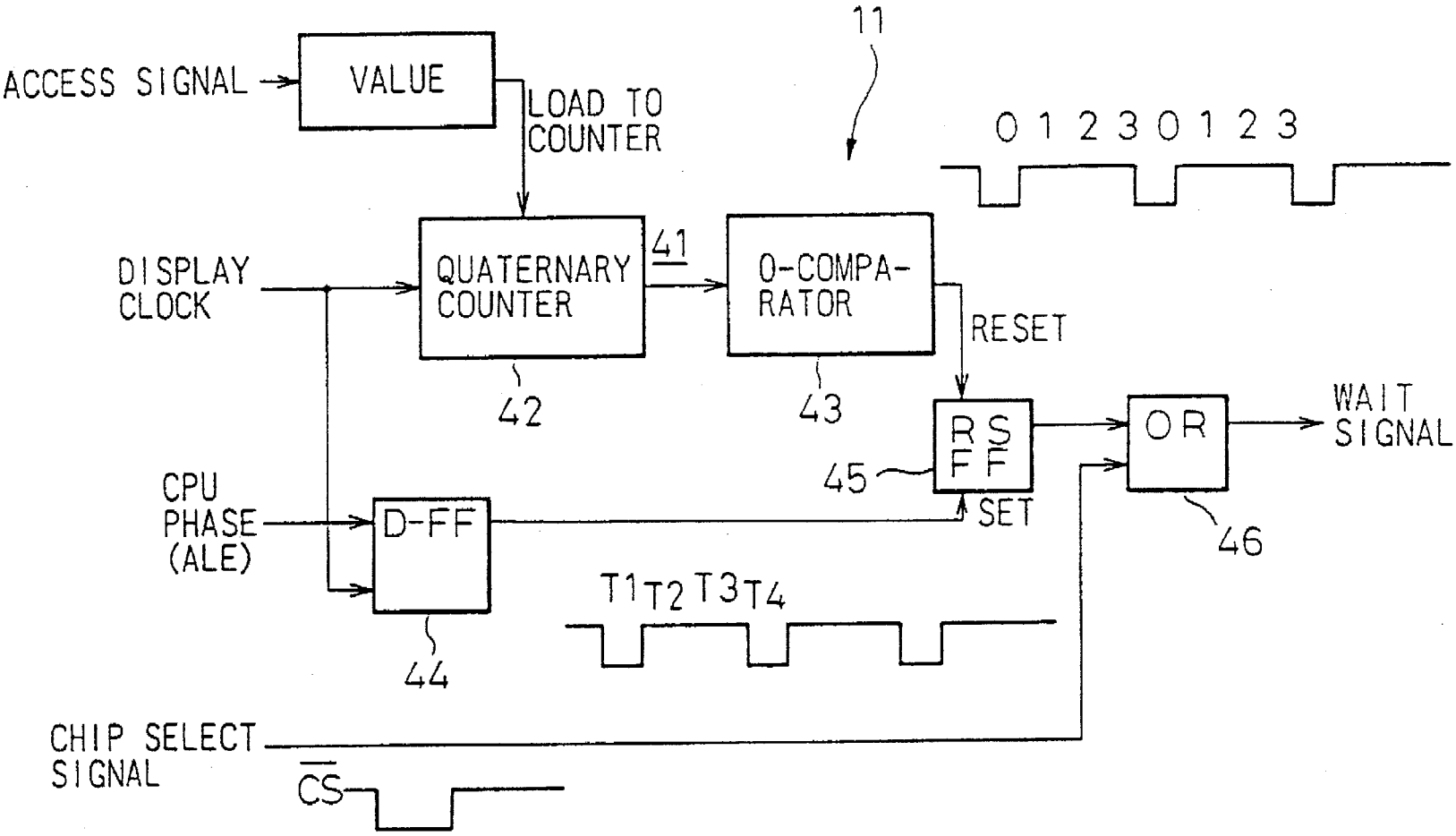
FIG. 6 is a view of a specific example of the relative phase detection unit.

FIG. 6 is a view of a specific example of the relative phase detection unit 11. The relative phase detection unit 11, as illustrated, has a quaternary counter 42 which is loaded with an initial value by the access signal and counts the display clocks. This "quaternary" setup is to match with the machine cycles T1 to T4. The 0-comparator 42 after the quaternary counter 41 outputs a reset signal each time the output of the quaternary counter 41 becomes 0. That is, the counter unit 41 comprised of the quaternary counter 42 and the 0-comparator 43 is incremented each time one of the machine cycles of the series of the plurality of machine cycles forming each operation cycle of the CPU 1 elapses and sends out a reset signal each time a machine cycle ends.

In the figure, the first flipflop unit 44 comprised for example of a D-flipflop (FF) sends out a set signal each time a timing signal for showing an operation cycle (for example ALE) is sampled at a timing of the start of the machine cycle.

In the figure, the second flipflop unit 45 comprised for example of an RS-flipflop (FF) is set by the set signal from the first flipflop unit 44, is reset by the reset signal from the counter unit 41, and sends out the signal produced during the reset period as the wait signal. After that the reset signal and the set signal are produced at the same timing, the set signal is given priority, and the wait signal is held at "H".

Figures 7A, 7B, 7C, 7D, 7E:
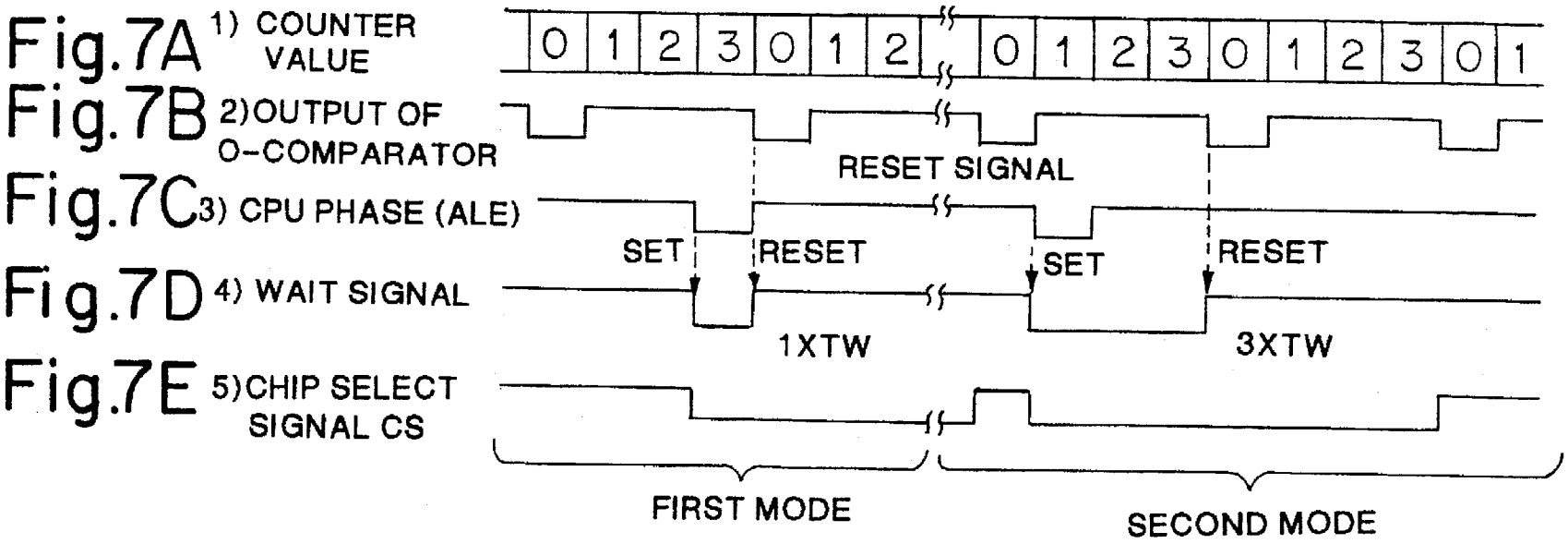
FIG. 7 is a time chart of the operation of the circuit of FIG. 6.

FIG. 7 is a time chart of the operation of the circuit of FIG. 6. 1) in the figure shows the count of the quaternary counter 42. Each time the count becomes 0, as shown in 2) of the figure, the reset signal is sent out from the output of the 0-comparator 43.

3) in the figure is the CPU phase (timing signal for display of operation cycle of CPU 1), for example, the signal ALE. Each time the signal ALE is generated, the flipflop 45 is set. It is reset by the output ("L") of the 0-comparator 43. 5) in the figure shows to make the wait signal of FIG. 4 valid just when there is a chip select signal CS. The OR gate 46 of FIG. 6 performs that function.

FIG. 7 illustrates the first mode and the second mode. The second mode corresponds to the example explained in FIG. 1 and FIG. 2. That is, when the signal ALE is at the position of the machine cycle T1 of FIG. 2, a wait signal corresponding to three wait cycles (3×TW) is output. In the first mode, the signal ALE is at a position corresponding to the machine cycle T3 of FIG. 2. This corresponds to the previously mentioned <2>, where a wait signal corresponding to one wait cycle (1×TW) is output.

The relative phase detection unit 11 shown in FIG. 6 basically has a similar configuration in the previously mentioned second embodiment.

The second embodiment differs from the first embodiment in the point that the CPU 1 and the display control unit 3 are fixed to a predetermined phase relationship at all times regardless of the presence or absence of access from the CPU 1 to the image memory 2 and at least two consecutive addresses worth of image data are prefetched at all times.

Accordingly, the second embodiment is excellent when handling a moving image as a display image, that is, in the case where it is necessary to rewrite the image memory 2 in bursts at predetermined periods.

Conversely, the first embodiment is excellent when continuously rewriting the image memory 2. When continuously rewriting the image memory 2, at the first rewrite, access of the image memory 2 without a wait becomes possible just by inserting for example the 3×TW wait signal shown in FIG. 2.

However, with the configuration of the first embodiment, if the image memory 2 is accessed in bursts at certain periods, a wait signal must be inserted at the start of every burst, and therefore in the final analysis, there ends up to be no difference from the conventional image display system. The second embodiment is excellent under these conditions.

As explained above, according to the present invention, there are the following effects.

First Embodiment (FIG. 1)

Only when starting access of the image memory 2 by the CPU 1 is the wait signal inserted and the phase adjusted between the CPU 1 and the display control unit 3. By this, the following continuous access is fixed in operation cycles (T1 to T4) to four machine cycles at least during the access. Therefore, it is possible to avoid conflict between the two accesses without inserting a wait cycle. Accordingly, high speed data transfer can be realized.

The access of the CPU 1 can be fixed to the machine cycles T2 and T3 and the access of the display control unit 3 can be fixed to the machine cycles T4 and T1.

By just introducing the relative phase detection unit 11, the present invention can be realized without making any changes to the conventional constituent elements.

The relative phase detection unit 11 can be realized simply by making use of the existing operation cycle display signals in the CPU.

By using the address latch enable signal (ALE) as the above operation cycle display signal, the external signals of the CPU can be used as they are.

The relative phase detection unit 11 can be realized by extremely simple hardware by the counter unit 41 and the flipflop units 44 and 45.

Second Embodiment

The operation cycle (T1 to T4) sometimes fluctuates by five machine cycles or even more, but the phase is constantly adjusted between the CPU 1 and the display control unit 3 and access by the display control unit 3 (fixed to four machine cycles if during an access) is performed by prefetching at least two consecutive addresses' worth of image data. Due to this, it becomes possible to access the image memory 2 without a wait cycle even when rewriting burst like image data.

The above prefetch can be performed by a high speed address signal just when accessing by the display control unit 3. Due to this, the time for opening the image memory 2 to the CPU 1 can be made much longer.

The above high speed address can be produced by the simple method of inverting the LSB of the address for two consecutive addresses.

The circuit of the second embodiment can be realized just by adding the simple hardware of the register unit 21 and selector unit 22 to the relative phase detection unit 11 of the first embodiment.

I claim:

1. A method for controlling an image display in an image display system provided with an image memory for storing the image data to be displayed, a control processor for accessing the image memory and rewriting the image data in the image memory to update it, and a display control unit for accessing the image memory periodically at access cycles alternating with the control processor to read out the image data and transfer it to an image display apparatus, said method comprised of:

a first step of, when the control processor requests rewriting of the image data in the image memory, detecting the relative deviation between the operational cycle of the control processor and the access cycle specified by the display control unit, a second step of inputting a wait signal of a length proportional to the size of the relative deviation which has been detected to the control processor, and a third step of having the control processor access the image memory using continuously the access cycle assigned to the control processor without input of any wait signal after the input of the first wait signal.

2. A method for controlling an image display as set forth in claim 1, wherein when the operational cycle of the control processor is defined by a repetition of the series of machine cycles T1, T2, T3, and T4, the correspondence between the size of the relative deviation and the length of the wait signal at the second step is set so that the access cycle allocated to the control processor at the third step is made to match with the machine cycles T2 and T3.

3. An apparatus for controlling an image display comprised of an image memory for storing the image data to be displayed, a control processor for accessing the image memory and rewriting the image data in the image memory to update it, a display control unit for accessing the image memory periodically at access cycles alternating with the control processor to read out the image data and transfer it to an image display apparatus, and a relative phase detection unit which detects the relative deviation between the operational cycle of the control processor and the access cycle specified by the display control unit and supplies a wait signal of a length proportional to the size of the detected relative deviation to the wait input terminal of the control processor.

4. An apparatus for controlling an image display as set forth in claim 3, wherein the relative phase detection unit uses a timing signal for showing the operational cycle produced conventionally in the control processor as the signal showing the operational cycle of the control processor.

5. An apparatus for controlling an image display as set forth in claim 4, wherein the timing signal for showing the operational cycle is made either an address latch enable signal (ALE) for displaying the timing where an address signal produced in the control processor becomes effective or a status signal for displaying the operational status in the control processor.

6. An apparatus as set forth in claim 3, wherein the relative phase detection unit is comprised of:

a counter unit which is incremented each time one machine cycle of a series of a plurality of machine cycles forming the operational cycle passes and sends out a reset signal each time a machine cycle ends, a first flipflop unit which sends out a set signal with each sampling of a timing signal for display of the operational cycle at the timing of the start of the machine cycle, and a second flipflop unit which is set by that set signal, is reset by that reset signal, and sends out a signal produced during that reset period as the wait signal.

7. A method for controlling an image display in an image display system provided with an image memory for storing the image data to be displayed, a control processor for accessing the image memory and rewriting the image data in the image memory to update it, and a display control unit for accessing the image memory periodically at access cycles alternating with the control processor to read out the image data and transfer it to an image display apparatus, said method comprised of:

a first step of detecting the relative deviation between the operational cycle of the control processor and the access cycle specified by the display control unit, a second step of inputting wait signal of a length proportional to the size of the relative deviation which has been detected to the control processor, adjusting the start of the operational cycle of the control processor to match with the start of the access cycle allocated to the Control processor, and setting the length of the access cycle allocated to the display control unit 3 shorter than the length of the access cycle allocated to the control processor, and a third step of having the display control unit prefetch at least two consecutive addresses' worth of image data from the image memory at each of the shorter set access cycles, then successively transfer them to the image display apparatus before the next access cycle allocated to the display control unit.

8. A method for controlling an image display as set forth in claim 7, wherein the speed of generation of the consecutive addresses is made to increase just when performing the prefetch.

9. A method for controlling an image display as set forth in claim 8, wherein when prefetching two consecutive addresses worth of image data, the logic of the least significant bit of the address given is made to invert at a speed of twice the ordinary speed of accessing the image memory.

10. An apparatus for controlling an image display comprised of an image memory for storing the image data to be displayed, a control processor for accessing the image memory and rewriting the image data in the image memory to update it, a display control unit for accessing the image memory periodically at access cycles alternating with the control processor to read out the image data and transfer it to an image display apparatus, a relative phase detection unit which detects the relative deviation between the operational cycle of the control processor and the access cycle specified by the display control unit and supplies a wait signal of a length proportional to the size of the detected relative deviation to the wait input terminal of the control processor, a register unit for holding the output read out from the image memory, and a selector unit for switching and outputting to the display control unit one of the output read out from the image memory and the read out output held at the register unit.

* * * * *